US009202655B2

(12) United States Patent
Bertrand

(10) Patent No.: US 9,202,655 B2
(45) Date of Patent: Dec. 1, 2015

(54) TRIP UNIT AND METHOD FOR PRODUCING ONE SUCH TRIP DEVICE

(71) Applicant: SCHNEIDER ELECTRIC INDUSTRIES SAS, Rueil-Malmaison (FR)

(72) Inventor: Mickael Bertrand, Grenoble (FR)

(73) Assignee: SCHNEIDER ELECTRIC INDUSTRIES SAS, Rueil-Malmaison (FR)

( * ) Notice: Subject to any disclaimer, the term of this patent is extended or adjusted under 35 U.S.C. 154(b) by 0 days.

(21) Appl. No.: 14/295,483

(22) Filed: Jun. 4, 2014

(65) Prior Publication Data

US 2014/0375400 A1 Dec. 25, 2014

(30) Foreign Application Priority Data

Jun. 20, 2013 (FR) ..... 13 55843

(51) Int. Cl.

| | |
|---|---|
| ***H01H 73/02*** | (2006.01) |
| ***H01H 71/10*** | (2006.01) |
| ***H01H 71/02*** | (2006.01) |
| ***H01H 71/12*** | (2006.01) |
| ***H01H 71/74*** | (2006.01) |

(52) U.S. Cl.

CPC ..... *H01H 71/1009* (2013.01); *H01H 71/0207* (2013.01); *H01H 71/12* (2013.01); *H01H 71/7418* (2013.01)

(58) Field of Classification Search

CPC ..... H01H 75/00; H01H 71/40; H01H 71/14; H01H 71/16

USPC ..... 335/21; 355/21

See application file for complete search history.

(56) References Cited

U.S. PATENT DOCUMENTS 2,922,007 A * 1/1960 Edmunds ..... 337/7
4,267,539 A * 5/1981 Guinan ..... 335/42

(Continued)

FOREIGN PATENT DOCUMENTS

| | | | |
|---|---|---|---|
| DE | 10 2007 010 944 | A1 | 12/2007 |
| EP | 1 077 461 | A2 | 2/2001 |
| EP | 1 420 431 | A1 | 5/2004 |

OTHER PUBLICATIONS

French Preliminary Search Report issued Mar. 14, 2014 in French Application 13 55843, filed on Jun. 20, 2013 ( with English Translation of Categories of Cited Documents and Written Opinion).

*Primary Examiner* — Shawki S Ismail
*Assistant Examiner* — Lisa Homza
(74) *Attorney, Agent, or Firm* — Oblon, McClelland, Maier & Neustadt, L.L.P.

(57) ABSTRACT

The trip unit (10) according to the invention is capable of being connected to a circuit breaker and includes a first block (12) and a second block (14). The first block (12) comprises a first case (16) and a circuit breaker trip member (20) accessible from outside the first case (16). The second block (14) comprises a second case (26) and at least one member (28) for detecting an electric fault. The first block (12) and the second block (14) are two distinct blocks relative to one another and the first case (16) and the second case (26) are capable of being mechanically assembled to one another in an assembled configuration of the trip unit (10). Each contact end (62) is capable of mechanically cooperating with the trip member (20), when the corresponding detecting member (28) detects an electric fault.

7 Claims, 9 Drawing Sheets

(56) References Cited

U.S. PATENT DOCUMENTS

| | | | | |
|---|---|---|---|---|
| 4,281,359 | A * | 7/1981 | Bayer et al. | 361/115 |
| 4,300,110 | A * | 11/1981 | Bayer et al. | 335/6 |
| 4,488,133 | A * | 12/1984 | McClellan et al. | 335/16 |
| 4,922,220 | A * | 5/1990 | Livesey et al. | 337/82 |
| 4,958,136 | A * | 9/1990 | Maier et al. | 335/42 |
| 5,467,069 | A * | 11/1995 | Payet-Burin et al. | 335/42 |
| 6,175,288 | B1 * | 1/2001 | Castonguay et al. | 335/16 |
| 6,211,758 | B1 * | 4/2001 | Castonguay et al. | 335/202 |
| 6,218,920 | B1 * | 4/2001 | Reichard et al. | 335/176 |
| 6,225,881 | B1 * | 5/2001 | Felden et al. | 335/172 |
| 6,239,677 | B1 * | 5/2001 | Ramakrishnan et al. | 335/35 |
| 6,255,925 | B1 * | 7/2001 | DiMarco et al. | 335/176 |
| 6,346,868 | B1 * | 2/2002 | Castonguay et al. | 335/172 |
| 6,362,711 | B1 * | 3/2002 | Larranaga et al. | 335/202 |
| 6,377,144 | B1 * | 4/2002 | Castonguay et al. | 335/202 |
| 6,379,196 | B1 * | 4/2002 | Greenberg et al. | 439/801 |
| 6,380,829 | B1 * | 4/2002 | Castonguay et al. | 335/68 |
| 6,388,213 | B1 * | 5/2002 | Letient et al. | 200/43.15 |
| 6,400,245 | B1 * | 6/2002 | Castonguay et al. | 335/202 |
| 6,421,217 | B1 * | 7/2002 | Castonguay et al. | 361/115 |
| 6,429,760 | B1 * | 8/2002 | Greenberg et al. | 335/202 |
| 6,479,774 | B1 * | 11/2002 | Castonguay et al. | 200/401 |
| 6,531,941 | B1 * | 3/2003 | Greenberg et al. | 335/202 |
| 6,586,693 | B2 * | 7/2003 | Castonguay | 200/318 |
| 6,784,770 | B2 * | 8/2004 | Gimenez et al. | 335/18 |
| 7,009,126 | B2 * | 3/2006 | Etscheidt et al. | 200/293 |
| 7,351,927 | B1 * | 4/2008 | Rakus et al. | 200/244 |
| 7,391,289 | B2 * | 6/2008 | McCoy et al. | 335/35 |
| 7,411,145 | B1 * | 8/2008 | Jones et al. | 200/400 |
| 7,518,074 | B2 * | 4/2009 | Weister et al. | 200/244 |
| 7,569,784 | B2 * | 8/2009 | Rakus et al. | 200/244 |
| 7,683,276 | B2 * | 3/2010 | Weister et al. | 200/244 |
| 8,183,490 | B2 * | 5/2012 | Gibson et al. | 218/147 |
| 2005/0062569 | A1 * | 3/2005 | Kumar et al. | 335/202 |
| 2008/0088394 | A1 * | 4/2008 | Weister et al. | 335/15 |
| 2008/0218296 | A1 * | 9/2008 | Weister et al. | 335/12 |
| 2009/0195346 | A1 * | 8/2009 | Bausch et al. | 337/13 |
| 2011/0193660 | A1 * | 8/2011 | Baek | 335/15 |

* cited by examiner

TRIP UNIT AND METHOD FOR PRODUCING ONE SUCH TRIP DEVICE

The present invention relates to a circuit breaker trip unit, as well as a method for manufacturing such a trip unit.

In the field of circuit breakers and in electrical installations, it is known to use a trip unit coupled to the circuit breaker in order to detect an electric fault and trip the opening of the circuit breaker contacts when that electric fault appears.

The trip unit generally assumes the form of a module that can be replaced by the consumer, in order to modify the electrical properties of the circuit breaker. The circuit breaker generally comprises a fixed electric contact and a moving electric contact moving between a closed position, where it is electrically connected to the fixed contact, and an open position, where it is electrically isolated from the fixed contact. The fixed contact is connected to a first connection terminal of the circuit breaker in the electrical installation and the moving contact is connected to a second connection terminal of the circuit breaker in the electrical installation. The circuit breaker is capable of opening the electrical connection between the two connection terminals, for example if an electric fault is detected. The electric trip unit includes a striker capable of tripping the opening of the moving contact of the circuit breaker and a trip rod mounted slidingly pivoting on a metal shaft and coupled to the striker. The trip rod is capable of releasing the striker, in order to move the moving contact to the open position, when an electric fault appears that is detected by the trip unit.

The known trip units generally comprise a single-piece case bearing all of the functional parts of the trip unit. The molding of the case is sometimes difficult to do, and the case may be fragile, depending on the desired dimensions for the trip unit. To install the metal shaft in the trip unit, two through holes are pierced in the case. However, it is necessary to replug these holes once the metal shaft is installed, for electrical insulation reasons.

Furthermore, it is known from EP-A2-1503396 to have a trip unit comprising a case made in two parts: a rear part that includes all of the functional elements of the trip unit and a front part in the form of a cover. The front part is mechanically assembled with the rear part to close the case. This type of trip unit is relatively complex to produce with all of the functional elements comprised in the rear part.

The aim of the invention is therefore to propose a trip unit that is easy to manufacture and has a low manufacturing cost.

To that end, the invention relates to a trip unit capable of being connected to a circuit breaker, said trip unit comprising a first block and a second block, the first block comprising a first case including two walls, each wall comprising a through orifice for receiving a shaft, a trip member of the circuit breaker mechanically connected to the shaft and accessible from outside the first case, the second block comprising a second case and at least one member for detecting an electric fault, each detecting member being positioned inside the second case and including at least one moving element comprising a contact end, capable of being moved toward the trip member, when it detects an electric fault. According to the invention, the first block and the second block are two distinct blocks relative to one another, whereas the first case and the second case are capable of being mechanically assembled to one another in an assembled configuration of the trip unit, and whereas each contact end is capable of mechanically cooperating with the trip member, such that the trip member is capable of tripping the circuit breaker in the assembled configuration of the trip unit, when the corresponding detecting member detects an electric fault.

Owing to the invention, the trip unit comprises distinct first and second cases that each include functional elements of the trip unit, which facilitates molding of the trip unit and makes it possible to have a trip unit that is easy and inexpensive to produce.

According to advantageous aspects of the invention, the trip unit further comprises one or more of the following features, considered alone or according to all technically admissible combination(s):

- the second case comprises two side walls capable of obstructing the through orifices in the assembled configuration of the trip unit, the shaft then not being accessible from outside the trip unit via said through orifices.
- the trip unit comprises at least one adjusting device capable of adjusting a distance between the trip member and the corresponding contact end, measured parallel to the movement of the contact end when an electric fault is detected in the assembled configuration of the trip unit.
- for each corresponding moving element, the adjusting device comprises an adjusting member that mechanically cooperates with the trip member and is capable of being moved toward or away from the corresponding contact end in the assembled configuration of the trip unit.
- the adjusting device comprises a first adjusting member capable of moving each contact end toward or away from the trip member, parallel to the movement of the contact end when an electric fault is detected in the assembled configuration of the trip unit, whereas the first adjusting member is accessible from an outer face of the first case.
- the adjusting device comprises a second adjusting member, for each corresponding moving element, capable of moving the corresponding contact end toward or away from the trip member, parallel to the movement of the contact end when an electric fault is detected in the assembled configuration of the trip unit.
- the first case comprises a first hole, the second case comprises a second hole, and in the assembled configuration of the trip unit, the first and second holes are aligned and capable of receiving a fastening member for fastening the first case to the second case.

The invention also relates to a method for manufacturing a trip unit capable of being connected to a circuit breaker, said trip unit comprising a first block and a second block, the first block comprising a first case including two walls, each wall comprising a through orifice for receiving a shaft, a trip member of the circuit breaker mechanically connected to the shaft and accessible from outside the first case, the second block comprising a second case and at least one member for detecting an electric fault, each detecting member being positioned inside the second case and including at least one moving element comprising a contact end capable of being moved toward the trip member, when it detects an electric fault. According to the invention, the method comprises the following steps:

a) mounting an assembly formed by the shaft and the trip member in the first case, b) mounting the detecting member in the second case, c) assembling the first case and the second case, the contact end being capable of cooperating mechanically with the trip member, such that the trip member is capable of tripping the circuit breaker, in the assembled configuration of the trip unit when the corresponding detecting member detects an electric fault.

Advantageously:

before step a), the first case and the second case are molded separately.

the trip unit comprises an adjusting member for each corresponding moving element, and after the assembly step, the adjusting member is used so as to calibrate the trip unit and set a distance between the trip member and the corresponding contact end, measured parallel to the movement of the contact end when an electric fault is detected in the assembled configuration of the trip unit.

The invention will be better understood, and other advantages thereof will appear more clearly, in light of the following description, provided solely as a non-limiting example, and done in reference to the appended drawings, in which.

Figure 1:
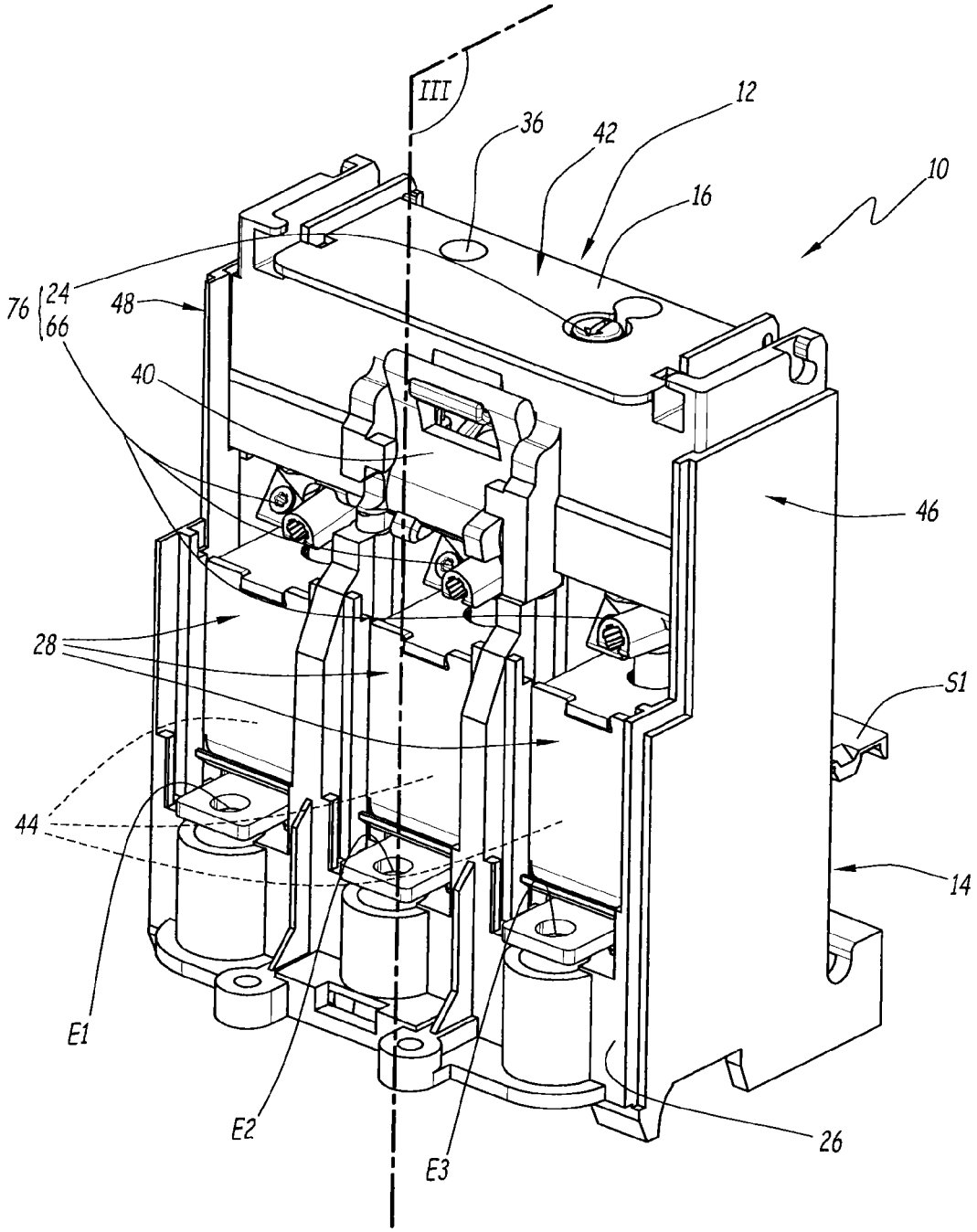
FIG. 1 is a perspective view, in the assembled configuration, of a trip unit according to a first embodiment of the invention.

In FIG. 1, a trip unit 10 capable of being connected to a multi-pole electric circuit breaker, not shown, includes a first block 12 and a second block 14 assembled to each other. The trip unit 10 is a three-pole trip unit comprising three poles, i.e., capable of being connected to a three-phase circuit breaker installed on a three-phase electrical installation, not shown.

The width of the trip unit 10, parallel to a longitudinal axis X, is comprised between 10 mm and 300 mm, preferably comprised between 27 mm and 108 mm based on the number of detecting members 28, i.e., based on the number of phases.

In the assembled configuration, the trip unit 10 has a height, parallel to a vertical assembly axis Z for assembling the first block 12 to the second block 14, comprised between 50 mm and 500 mm, preferably comprised between 80 mm and 120 mm, still more preferably equal to 105 mm.

The trip unit 10 is for example a magnetic trip unit.

Y denotes a transverse axis of the trip unit 10.

The first block 12 comprises a first case 16, a first shaft 18, also called first axis, a trip member 20 and a first member 24 for adjusting the position of the trip member.

The second block 14 comprises a second case 26, three connection pads E1, E2, E3, capable of receiving a current as input of the second block 14, also called current input terminals and forming three inputs E1, E2, E3 of the second block 14, three connection pads S1, S2, S3, capable of delivering an output current of the second block 14, also called current output terminals and forming three outputs S1, S2, S3 of the second block 14, and three members 28 for detecting an electric fault.

Figure 2:
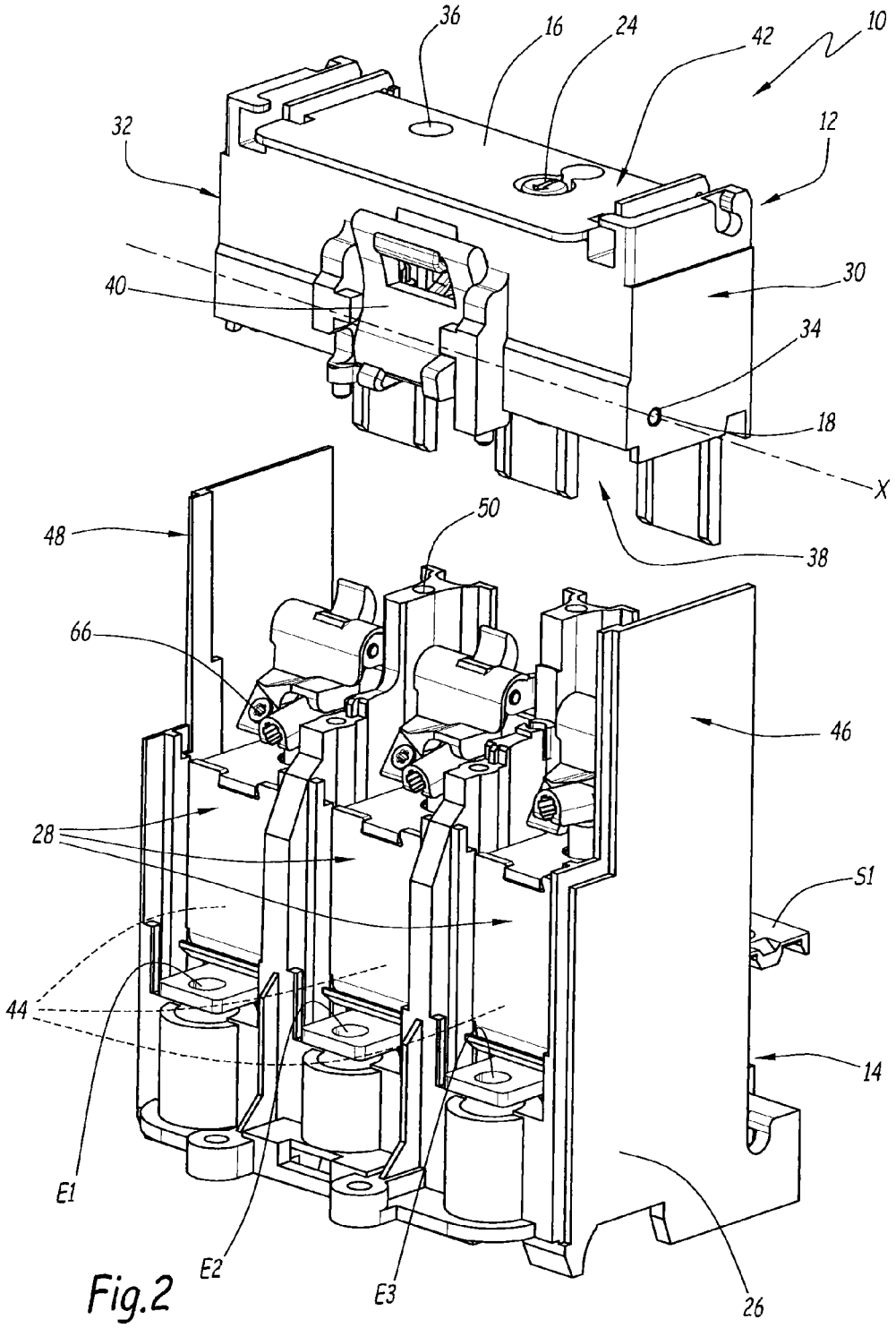
FIG. 2 is an exploded view of the trip unit of FIG. 1.
Figure 3:
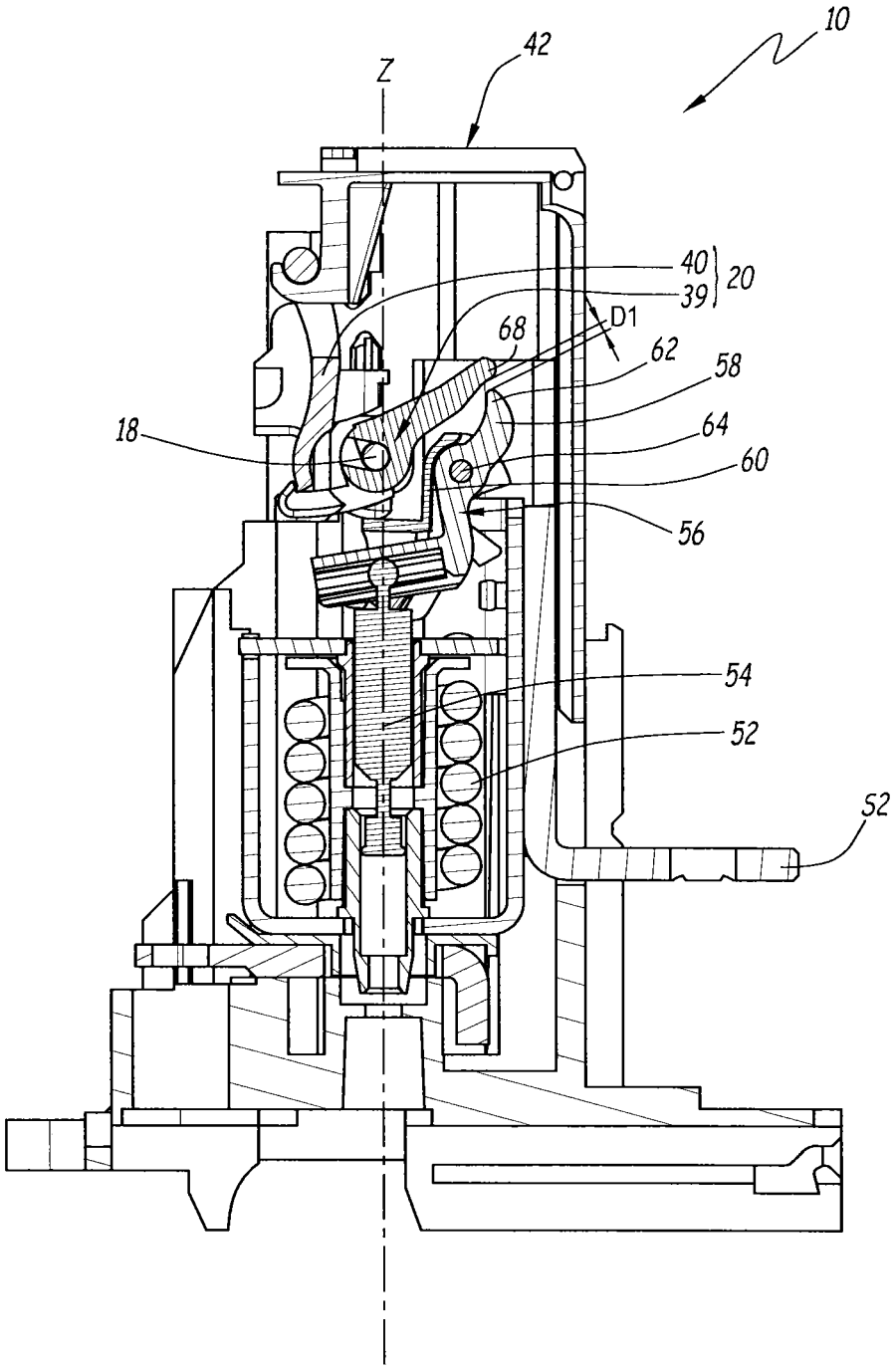
FIG. 3 is a cross-sectional view along plane III of FIG. 1.
Figure 4:
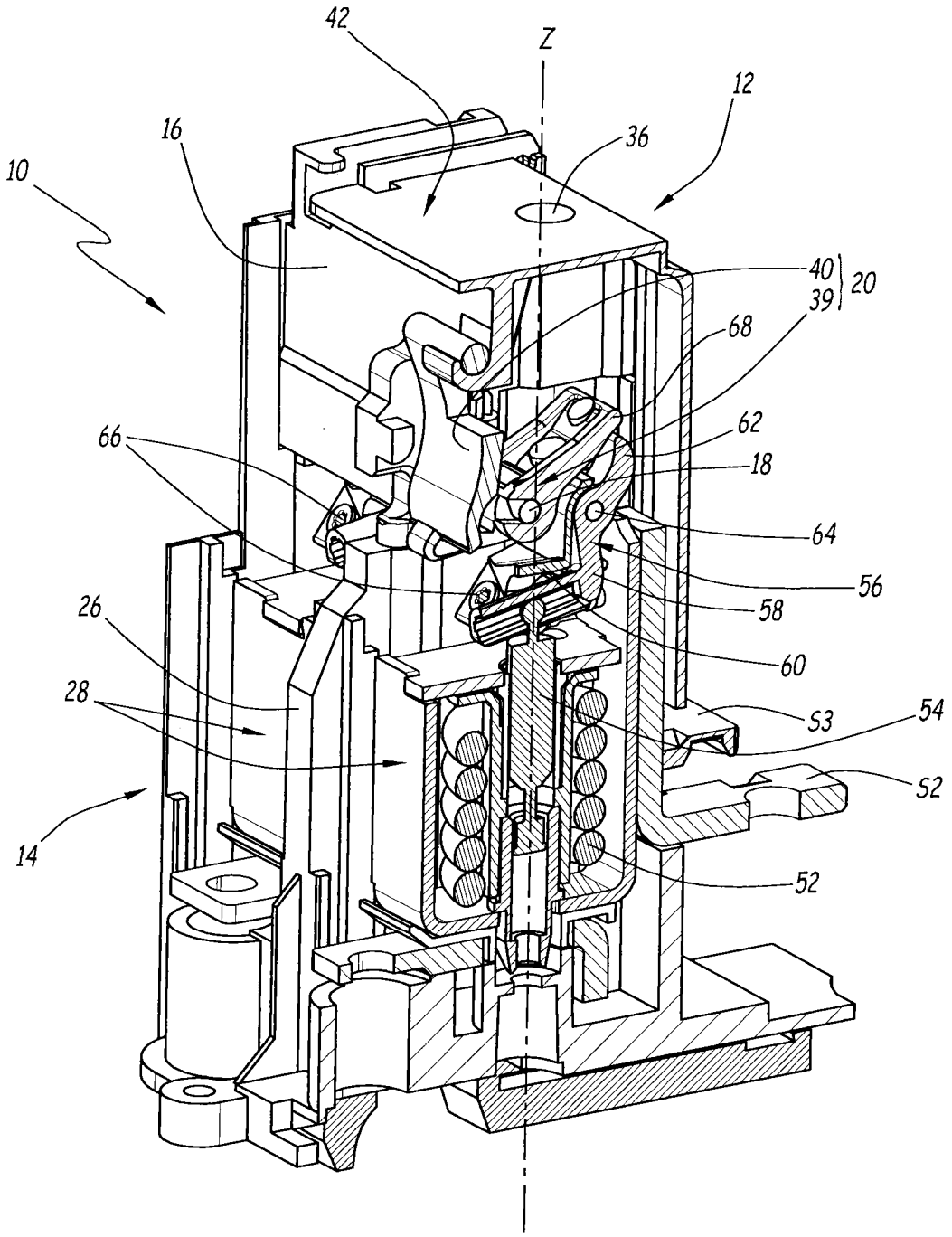
FIG. 4 is a perspective view of the cross-section of FIG. 3.
Figure 5:
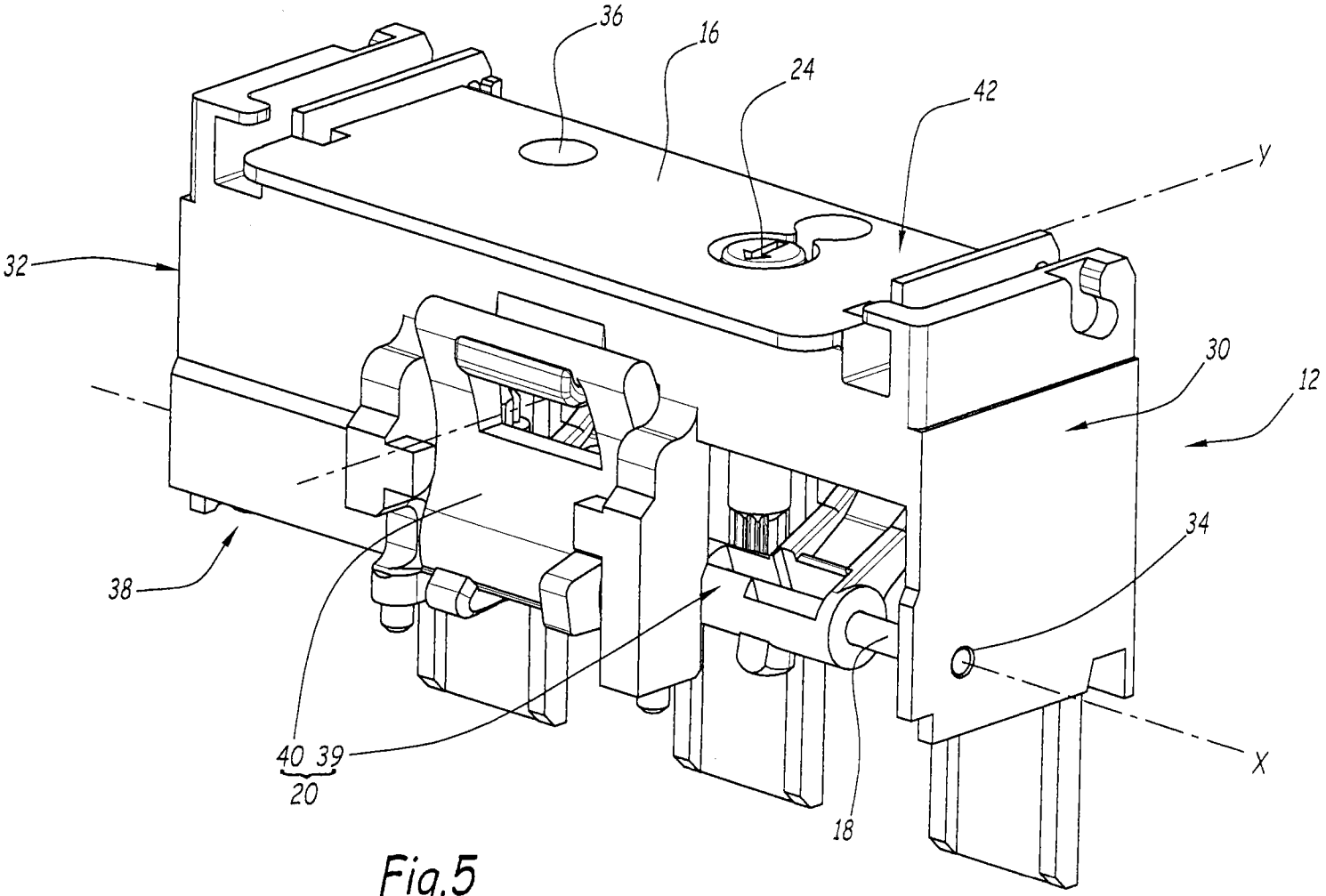
FIG. 5 is a perspective view of a first block of the trip unit of FIG. 1, in which certain elements have been hidden.
Figure 6:
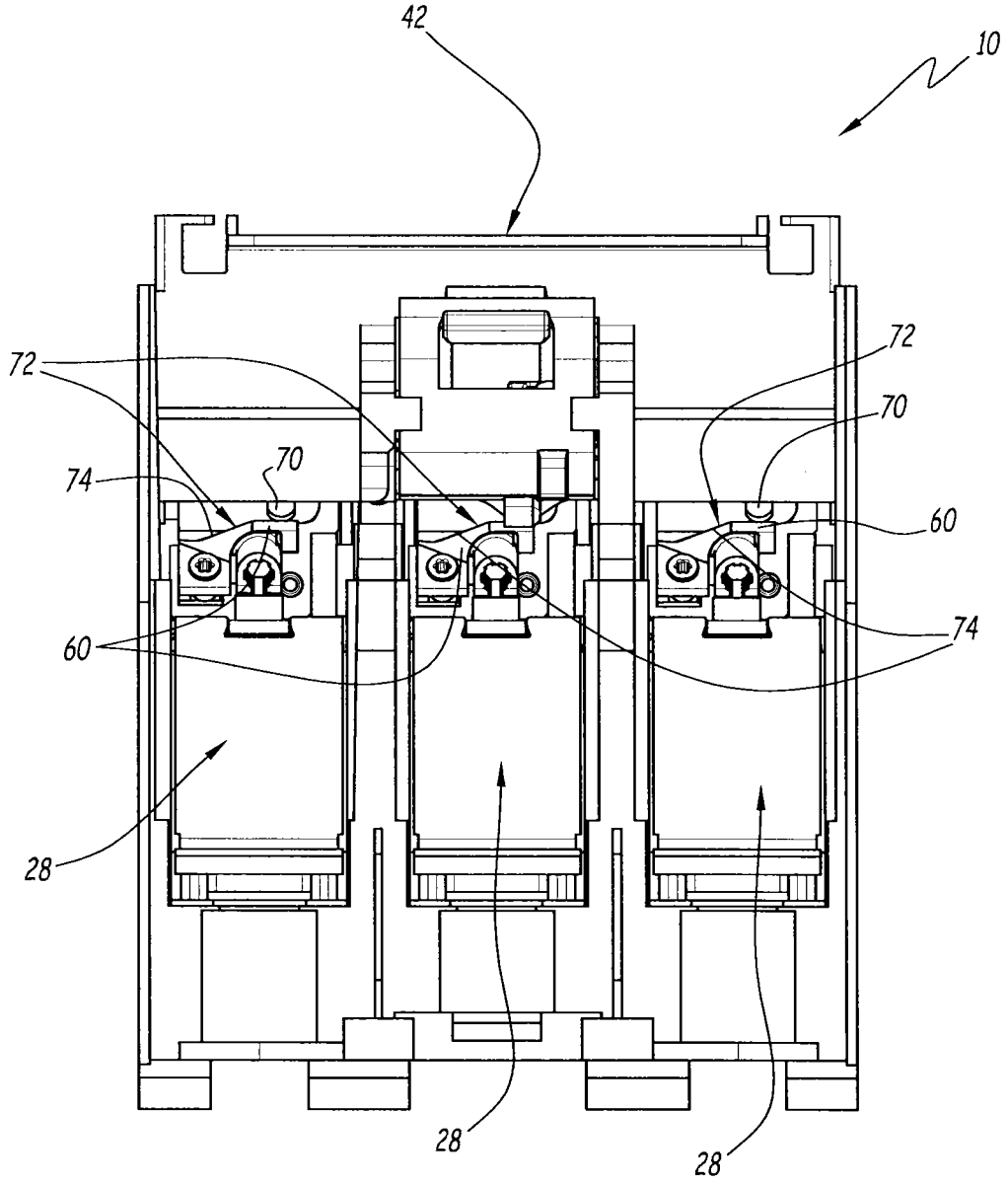
FIG. 6 is a front view, in the assembled configuration of the trip unit of FIG. 1.

The first case 16 comprises two walls 30 and 32 in which two through orifices 34 are formed for receiving the first shaft 18. The wall 32 is identified in FIG. 2 by one of its edges, and only one of the two through orifices 34 is visible in FIGS. 2 and 5. The axis of the two through orifices 34 is for example parallel to the longitudinal axis X, and the walls 30, 32 are preferably side walls perpendicular to the longitudinal axis X.

Additionally, the first case 16 includes a first through hole 36 capable of receiving a member, not shown, for fastening the first block 12 to the second block 14, i.e., the first case 16 to the second case 26.

The first case 16 also comprises a lower face 38 that is globally open toward the outside, such that the trip member 20 is accessible from that lower face 38.

The first shaft 18 is positioned parallel to the longitudinal axis X and received in the through orifices 34.

The trip member 20 comprises a trip rod 39 and a striker 40.

The first adjusting member 24 is capable of adjusting the position of the trip member 20, more particularly of the trip rod 39, relative to the first shaft 18, parallel to the longitudinal axis X. The first adjusting member 24 is accessible from an upper outer face 42 of the first case 16, opposite the lower face 38.

The second case 26 defines three housings 44 capable of receiving the three detecting members 28. The second case 26 comprises two side walls 46 and 48 positioned on either side of the detecting members 28 and the geometry of which is adapted such that the first case 16 is mechanically assembled with the second case 26. When the first case 16 and the second case 26 are mechanically assembled, the trip unit is in an assembled configuration. The second case 26 also includes a second hole 50 capable of receiving the fastening member for fastening the first block 12 to the second block 14, i.e., the first case 16 to the second case 26.

Each detecting member 28 is associated with a different input E1, E2, E3 and output S1, S2, S3. The detecting members 28 are capable of measuring the intensity of the current passing through each pole, i.e., each of the phases. Additionally, each detecting member 28 comprises a coil 52 for commanding the trip unit 10, which surrounds a moving magnetic core 54, which in turn is mechanically associated with a moving element 56. The moving element 56 comprises a cam follower 58 and an adjusting element 60, the cam follower 58 including a contact end 62 with the trip rod 39.

Each detecting member 28 comprises a second shaft 64, also called second axis, and a second member 66 for adjusting the position of the moving core 54 relative to the command coil 52, and thus the position of the moving element 56.

The trip rod 39 is secured in slidable pivoting connection with the first shaft 18. The trip rod 39 is shared by each pole, i.e., each phase. The trip rod 39 includes a trip tab 68 and an adjusting tab 70 each corresponding to a different phase. Furthermore, the trip rod 39 is capable of retaining the striker 40 when no electric fault has appeared, and releasing the striker 40 when an electric fault appears.

The striker 40 is capable of cooperating with the trip rod 39 and causing the opening of the circuit breaker contacts, if a fault current is detected by one of the detecting members 28.

The side walls 46 and 48 are capable, in the assembled configuration of the trip unit, of obstructing the through orifices 34 such that the first shaft 18 is not accessible from outside the trip unit via said through orifices 34.

Each command coil 52 is capable of commanding the movement of the corresponding moving core 54 based on the current passing through it.

Each moving magnetic core 54 is mechanically connected to the corresponding moving element 56 and is capable of driving the movement thereof. Each moving core 54 is capable of moving parallel to the vertical assembly axis Z of the first 16 and second 26 cases.

Each moving element 56 is secured in rotation with the corresponding second shaft 64 and is capable of rotating around the second shaft 64 when the corresponding moving core 54 moves. In the assembled configuration of the trip unit 10, each moving element 56 is positioned, along the vertical axis Z, below the trip member 20. More specifically, when the trip unit 10 is in the assembled configuration, each contact end 62 is across from the corresponding trip tab 68.

The position of each moving element 56 and the corresponding moving core 54 depends on the current passing through the corresponding command coil 52.

Each cam follower 58 is secured in rotation to the second corresponding shaft 64.

Each adjusting element 60 is secured in rotation to the second corresponding shaft 64 and mechanically connected to the corresponding cam follower 58. Each adjusting element 60 comprises a contact face 72 with the corresponding adjusting tab 70, when the trip unit is in the assembled configuration.

Each contact end 62 is capable of mechanically cooperating with the trip member 20, when the corresponding detecting member 28 detects an electric fault. More specifically, in the assembled configuration of the trip unit 10, each contact end 62 is capable of coming into contact with the corresponding trip tab 68, so as to actuate the trip rod 39, when the corresponding detecting member 28 detects an electric fault.

Each second shaft 64 is positioned parallel to the first shaft 18.

Each second adjusting member 66 is a screw making it possible to fix the position of the adjusting element 60 and the cam follower 58, i.e., of the moving element 56, and therefore of the moving core 54 along the vertical axis Z.

Each adjusting tab 70 makes it possible to fix the position of the corresponding adjusting element 60, in the assembled configuration of the trip unit 10. In fact, the adjusting element 60 is capable of abutting, by rotation on the second shaft 64, against the corresponding adjusting tab-70.

Each contact face 72 comprises a portion 74 that is inclined relative to the first shaft 18 and the longitudinal axis X.

When the trip unit 10 is in the assembled configuration, as shown in FIG. 1, and when an electric fault appears on a phase, a fault current passes through the corresponding coil 52 and creates a variation in the magnetic field generated by the coil 52. This causes the corresponding moving core 54 to move. Thus, the moving core 54 moves, along the vertical axis Z, opposite the first case 16 and rotates the corresponding moving element 56 around the second corresponding shaft 64. Then, the contact end 62 comes into contact with the corresponding trip tab 68, which causes rotational movement of the trip rod 39. The movement of the trip rod 39 causes the release of the striker 40, which trips the opening of the circuit breaker.

The position of the moving element 56 varies based on the position of the moving magnetic core 52 and the presence or absence of an electric fault. More specifically, it suffices for a detecting member 28 to detect an electric fault on one of the phases for the corresponding moving element 56 to come into contact with the corresponding trip tab 68 and trip the trip rod 39. The striker 40 is then released and trips the opening of the circuit breaker contacts, i.e., trips the circuit breaker.

The first hole 36 and the second hole 50 are aligned in the assembled configuration of the trip unit 10 and are capable of receiving the fastening member for fastening the first case 16 to the second case 26.

When the trip unit 10 is in the assembled configuration and the first adjusting member 24 is used, the trip rod 39 translates along the first shaft 18, which allows a simultaneous modification of the position of each adjusting tab 70, along the longitudinal axis X. This modification of the position of each adjusting tab 70 makes it possible to modify the position of the adjusting element 60, and therefore of the moving element 56 and the moving core 54. In fact, during this adjustment, the adjusting tab 70 is translated along the inclined portion 74, which abuts against the adjusting tab 70.

Based on the translation of the adjusting tab 70, the adjusting element therefore rotates around the second shaft 64 by a larger or smaller angle, so as to abut against the adjusting tab 70. The first adjusting member 24 thus makes it possible to calibrate the trip unit 10, and consequently to adjust the position of the adjusting element 60, and by mechanical connection to adjust the position of the moving element 56 relative to the trip member 20. A first distance D1 between the contact end 62 and the trip member 20 is thus adjusted, that first distance D1 being measured parallel to the movement of the contact end 62 when an electric fault is detected in the assembled configuration of the trip unit 10.

The first adjusting member 24 can be actuated by an operator and makes it possible to adjust the protection rating of the trip unit 10, and therefore the circuit breaker.

The first adjusting member 24 and the second adjusting members 66 form an adjusting device 76 capable of adjusting the first distance Dl.

Each second adjusting member 66 makes it possible to fix the position of the corresponding adjusting elements 60, and thus of the corresponding moving element 56 and the corresponding moving core 54. This is an individual adjustment by phase, done in the factory, to calibrate the trip unit and have the same trip rating for each phase, i.e., for each detecting member 28. The initial idle position of the moving core 54 relative to the coil 52, along the vertical axis Z, is thus determined. By mechanical connection, each second adjusting member 66 therefore makes it possible to fix the position of the corresponding moving element 56 and the corresponding contact end 62, relative to each trip tab 68 and the trip rod 39. The first distance D1 between the contact end 62 and the trip member 20 is thus adjusted.

Figure 7:
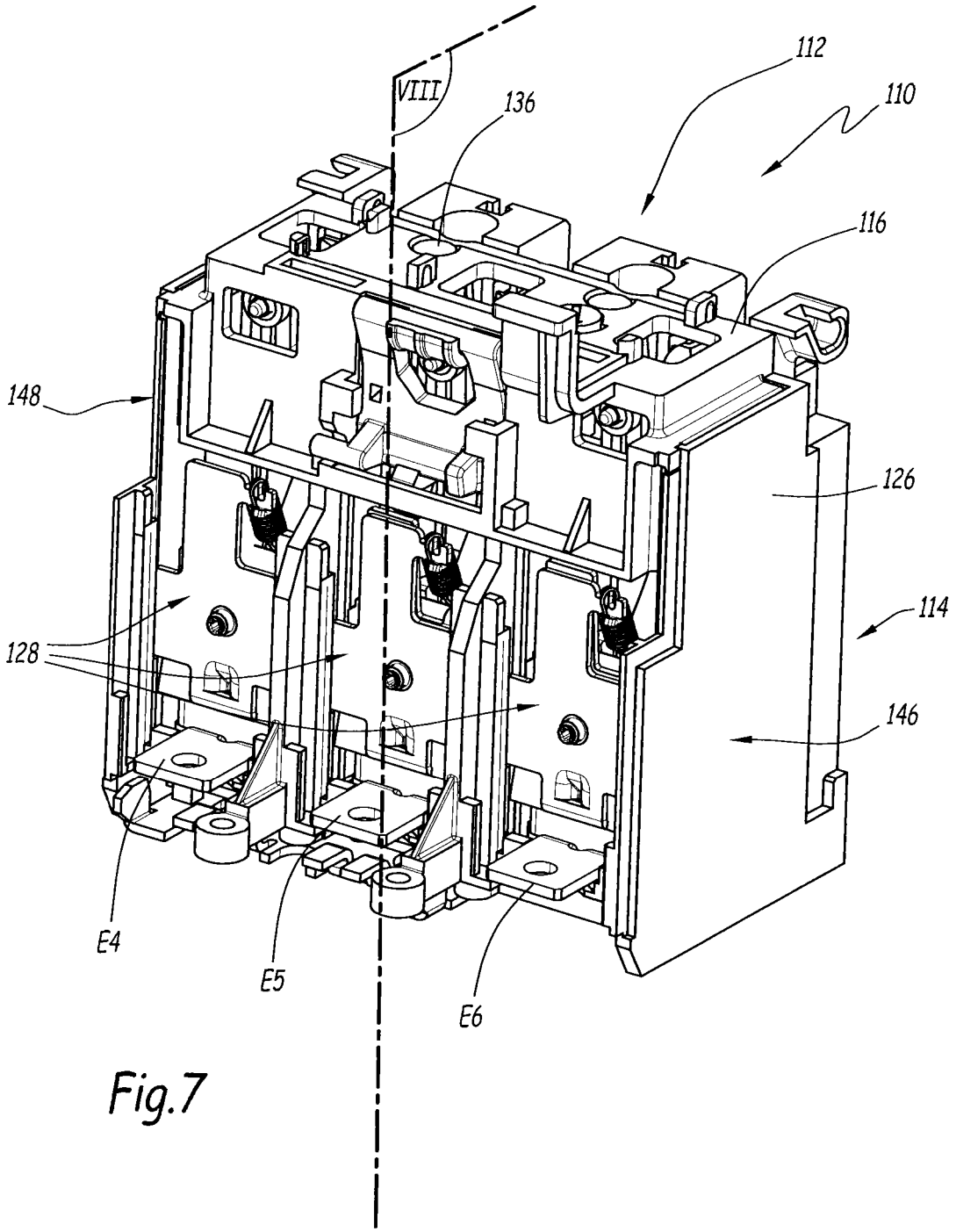
FIG. 7 is a view similar to that of FIG. 1 according to a second embodiment of the invention.

FIG. 7 shows a trip unit 110 according to a second embodiment of the invention. The trip unit 110 is capable of being connected to a multi-pole electric circuit breaker, not shown.

The trip unit 110 comprises a first block 112 and a second block 114. The trip unit 110 differs from the trip unit 10 of the first embodiment in that it involves a magnetothermal trip unit, i.e., it is capable of performing both magnetic detection and thermal detection of an electric fault.

The first block 112 comprises a first case 116, a first shaft 118, also called first axis, a trip member 120 and an adjusting device 124 for adjusting the position of the trip member 120.

Figure 8:
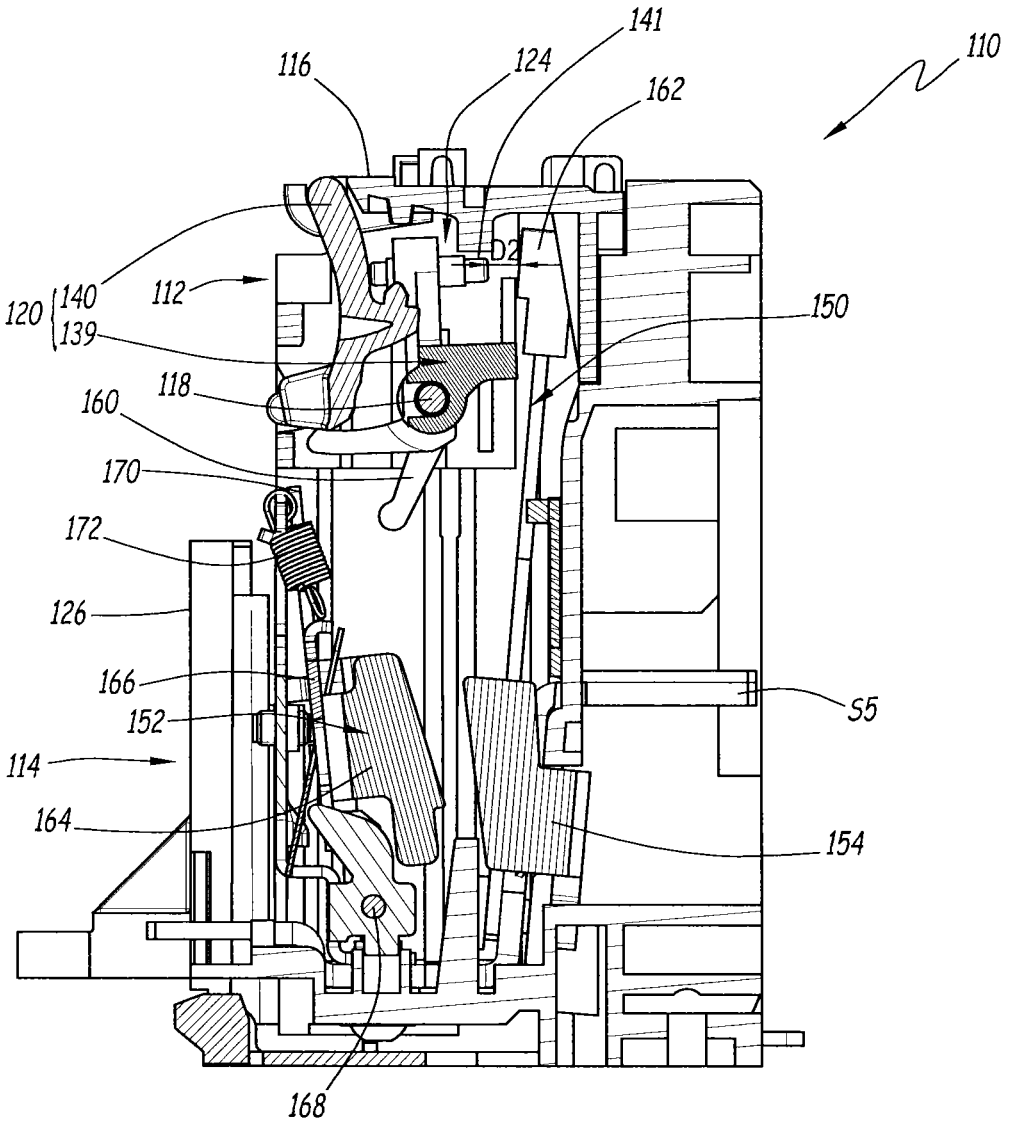
FIG. 8 is a cross-sectional view of the trip unit in plane VIII of FIG. 7.

The second block 114 comprises a second case 126, three connection pads E4, E5, E6, capable of receiving an input current of the second block 114, also called current input terminals and forming three inputs E4, E5, E6 of the second block 114, three connection pads, capable of delivering an output current of the second block 114, also called current output terminals and forming three outputs of the second block 114, only one S4 of which is shown in FIG. 8, and three members 128 for detecting an electric fault.

Figure 9:
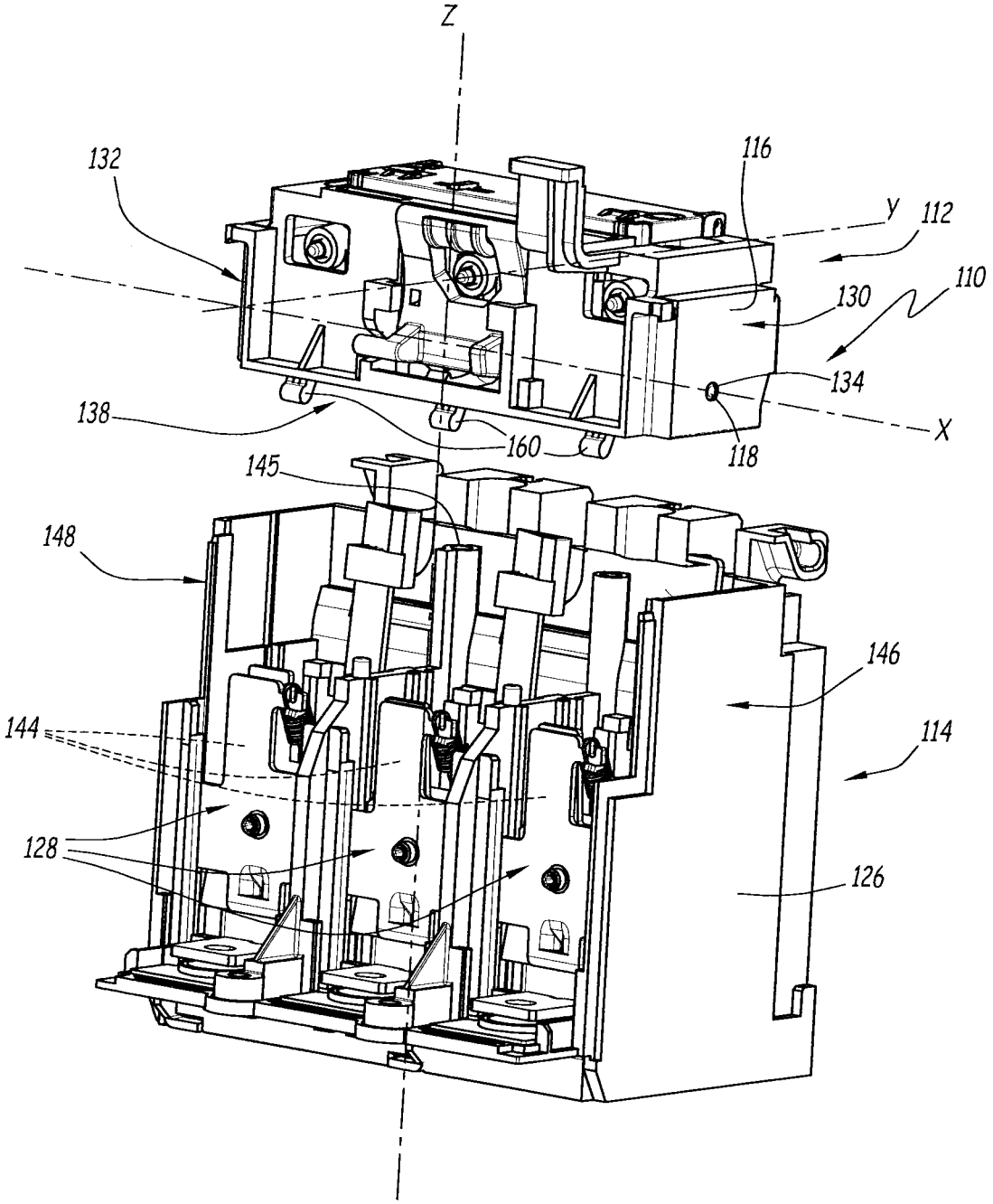
FIG. 9 is an exploded view of the trip unit of FIG. 7.

The first case 116 comprises, similarly to what was described for the first embodiment, two walls 130 and 132, in which two through orifices 134 are formed for receiving the first shaft 118, only one of which is shown in FIG. 9. The first case 116 also includes a first through hole 136 capable of receiving a fastening member, not shown, for fastening the first case 116 to the second case 126, as well as a lower face 138 globally open toward the outside of the first case 116. Thus, the trip member 120 is accessible from that lower face 138.

The first shaft 118 is positioned in the through orifices 134 and extends along the longitudinal axis X.

The trip member 120 comprises a trip rod 139 and a striker 140.

The adjusting device 124 comprises three moving slugs 141, also called adjusting members, only one of which is shown in FIG. 8. The adjusting device 124 mechanically cooperates with the trip member 120 and is capable of fixing the position of the moving slugs 141, along the transverse axis Y globally parallel to the walls 130 and 132.

The second case 126 defines three housings 144 capable of receiving the three detecting members 128 for detecting an electric fault. The second case 126 comprises two side walls 146 and 148, positioned on either side of the detecting members 128 and the geometry which is adapted such that the first case 116 is mechanically assembled with the second case 126. When the first case 116 is assembled to the second case 126, the trip unit 110 is in the assembled configuration.

The second case 26 also includes a second hole 145 capable of receiving the member for fastening the first block 112 to the second block 114, i.e., the first case 116 to the second case 126.

The assembly axis for assembling the first case 116 to the second case 126 is for example parallel to the vertical axis Z.

Each detecting member 128 is associated with a different input E1, E2, E3 and current output S4. Each detecting member 128 is capable of measuring the intensity of the current passing through the corresponding pole, i.e., associated with the corresponding phase. Each detecting member 128 also comprises a first moving element 150, a second moving element 152 and a fixed magnetic block 154.

The trip rod 139 is secured in rotation with the first shaft 118. The trip rod 139 is shared by each pole, i.e., each phase. The trip rod 139 comprises three trip tabs 160 each corresponding to a different phase. Additionally, the trip rod 139 is capable of retaining the striker 140 when no electric fault appears and releasing the striker 140 when an electric fault appears.

The striker 140 is capable of operating with the trip rod 139 and causing the circuit breaker contacts to open if a fault current is detected by one of the detecting members 128.

The side walls 146 and 148 are capable, in the assembled configuration of the trip unit 110, of obstructing the through orifices 134, such that the first shaft 118 is not accessible from outside the trip unit via said through orifices 134.

Each first moving element 150 is a bimetallic strip capable of being deformed when an electric fault appears and comprises a first contact end 162 with the moving slug 141.

Each second moving element 152 comprises a moving magnetic block 164 and a contact block 166 secured in rotation with a second shaft 168, also called second axis, parallel to the first shaft 118.

Each fixed magnetic block 154 is capable of being passed through by a current when the trip unit 110 is associated with the circuit breaker, which in turn is connected to an electrical installation, not shown. When it is passed through by that current, each fixed magnetic block 154 is capable of generating a magnetic field capable of influencing the position of the corresponding second moving element 152 relative to the corresponding fixed magnetic block 154.

Each first contact end 162 is capable of being moved in contact with the moving slug 141 when an electric fault appears.

The context block 166 comprises a second contact end 170 capable of coming into contact with the corresponding trip tab 160 when an electric fault appears.

A spring 172 connects the second case 126 to the second moving element 152. The dimensions of the spring 172 determine the value of the magnetic field, generated by the fixed magnetic block 154, from which the moving magnetic block 164 is moved.

The adjusting device 124 makes it possible to adjust a second distance D2 between the trip member 120, in particular the moving slug 141, and the corresponding first contact end 162, measured parallel to the movement of the first contact end 162 when an electric fault appears, in the assembled configuration of the trip unit 110.

When an electric fault appears on a phase, corresponding to an electric overload on the electrical installation, the bimetallic strip, i.e., the corresponding first moving element 150, heats up and deforms until it comes into contact with the corresponding moving slug 141. This, by mechanical connection between the corresponding moving slug 141 and the trip rod 139, causes the movement of the trip rod 139, which releases the striker 140. Then, the striker 140 trips the opening of the circuit breaker contacts, i.e., again trips the circuit breaker.

When an electric fault appears on a phase, corresponding to a short circuit in the electrical installation, the corresponding fixed magnetic member 154 is passed through by a very high current and generates a magnetic field, such that the corresponding moving magnetic element 164 moves in order to come into contact with the corresponding fixed magnetic element 154. The movement of the moving magnetic element 164 causes the rotation of the corresponding contact member 166 around the corresponding second shaft 168. The corresponding second contact end 170 then comes into contact with the corresponding trip tab 160. This causes the trip rod 139 to rotate, which releases the striker 140 and trips the opening of the circuit breaker contacts.

The height and width of the trip unit 110 are substantially identical to those of the trip unit 10 of the first embodiment.

A method for manufacturing a trip unit 10, 110 according to the first and second embodiments comprises the following various steps. A first step consists of mounting the striker 40, 140 in the first case 16, 116, then mechanically connecting the trip rod 39, 139 with the first shaft 18, 118, to next mount the assembly formed by the trip rod 39, 139 and the first shaft 18, 118 in the first case 16, 116, i.e., to position the first shaft 18, 118 in the through orifices 34, 134 and mechanically associate the trip rod 39, 139 with the striker 40, 140, to form the trip member 20, 120. A second step consists of mounting the detecting member 28, 128 in the second case 26, 126. Following the first step and the second step, one has a first case 16, 116 and a second case 26, 126 that can be assembled. Then, a third step consists of assembling the first case 16, 116 of the second case 26, 126, each moving element 56, 150, 152 comprising a contact end 62, 162, 170 capable of cooperating mechanically with the trip member 20, 120 such that the trip member 20, 120 trips the opening of the circuit breaker contacts, in the assembled configuration of the trip unit 10, 110, when the corresponding detecting member 18, 118 detects an electric fault.

Furthermore, during the manufacture of the first case 16, 116 and the second case 26, 126, prior to the first step, the first case 16, 116 and the second case 26, 126 are molded separately.

Having a two-part trip unit 10, 110 makes it possible to mold a first case 16, 116 and a second case 26, 126 separately, the two cases having globally simple shapes. The first 16, 116 and second 26, 126 cases are then inexpensive parts to produce that do not require a high degree of precision in terms of size. The fact that the trip unit 10, 110 comprises a first case 16, 116 and a second case 26, 126 makes it possible to obtain the necessary sizing precision for the operation of the trip unit 10, 110 more easily than with a single-piece trip unit 10, 110.

In the first embodiment, a fourth step following the third step consists of using each second adjusting member 66 in order to fix the position of the corresponding moving core 54 and of the corresponding moving element 56 relative to the corresponding trip tab 68.

More specifically, this adjustment makes it possible to calibrate the trip unit, i.e., to fix the position of the contact end 62 relative to the trip member 20. The first distance D1 between the corresponding contact end 62 and the trip member 20, measured parallel to the movement direction of the contact end 62 when an electric fault appears, in the assembled configuration of the trip unit, is thus adjusted.

In the second embodiment, a fifth step unified with the third step consists of moving each adjusting member, i.e., each moving slug 141, using the adjusting device 124, along the transverse axis Y. Then, the position of each moving slug 141 is fixed by welding once its position corresponds to the desired rating for the trip unit. Thus, the second distance D2 is fixed between the trip member 120 and the corresponding contact end 162, measured parallel to the movement of the contact end, when an electric fault appears in the assembled configuration of the trip unit.

Additionally, the first adjusting member 24 allows the client to calibrate the trip unit without disassembling the first case 16 and the second case 26. It thus makes it possible to adjust the first distance D1 between the trip rod 39 and the moving element 56 simultaneously for each phase, and thus to modify the rating of the trip unit.

The second adjusting member 66 allows an individualized adjustment by phase, so as to compensate for dispersions, in terms of dimensions, during the assembly of the first case 16 and the second case 26. This allows lower manufacturing precision during molding of the first case and the second case than in the case of the single-piece trip unit of the state of the art.

The first case 16, 116 and the second case 26, 126 each comprise functional elements that make it possible to simplify the molding of the two cases compared to a single-piece solution.

Furthermore, the connection between the first block 12, 112 and the second block 14, 114 is done using a stable mechanical assembly, such as a system of guideways, stops and screws.

Additionally, the adjusting device 124 and the first adjusting member 24 make it possible to adjust the protection rating of the trip unit, i.e., of the circuit breaker.

Lastly, the second block 14, 114, and more particularly the second case 26, 126, make it possible to electrically isolate the first shaft 18, 118 from the outside of the case, while respecting the width of the final product. It is thus possible to produce the through orifices in order to mount the shaft in the first case, then to obstruct them easily without a complex operation or a complex structure being necessary.

The number of poles of the trip units present is not limiting on the invention, i.e., the trip unit is for example alternatively a single-phase trip unit. In that case, it comprises a single detection member 28, 128.

The invention claimed is:

1. A trip unit that connects to a circuit breaker, said trip unit comprising:

a first block comprising a first case including two walls, each wall comprising a through orifice for receiving a shaft, and a trip member of the circuit breaker mechanically connected to the shaft and accessible from outside the first case; and a second block comprising a second case and at least one detecting member for detecting an electric fault, each detecting member being positioned inside the second case and including at least one moving element comprising a contact end, that is movable toward the trip member when the respective detecting member detects an electric fault, wherein the first block and the second block are two distinct blocks relative to one another, wherein the first case and the second case are mechanically assembled to one another in an assembled configuration of the trip unit, and wherein each contact end mechanically cooperates with the trip member such that the trip member trips the circuit breaker in the assembled configuration of the trip unit when the corresponding detecting member detects an electric fault.

2. The trip unit according to claim 1, wherein the second case comprises two side walls obstructing the through orifices in the assembled configuration of the trip unit, the shaft then not being accessible from outside the trip unit via said through orifices.

3. The trip unit according to claim 1, wherein the trip unit comprises at least one adjusting device adjusting a distance between the trip member and the corresponding contact end, measured parallel to the movement of the contact end when an electric fault is detected in the assembled configuration of the trip unit.

4. The trip unit according to claim 3, wherein for each corresponding moving element, the adjusting device comprises an adjusting member that mechanically cooperates with the trip member and is moveable toward or away from the corresponding contact end in the assembled configuration of the trip unit.

5. The trip unit according to claim 3, wherein the adjusting device comprises a first adjusting member moving each contact end toward or away from the trip member, parallel to the movement of the contact end when an electric fault is detected in the assembled configuration of the trip unit, and wherein the first adjusting member is accessible from an outer face of the first case.

6. The trip unit according to claim 5, wherein the adjusting device comprises a second adjusting member, for each corresponding moving element, moving the corresponding contact end toward or away from the trip member, parallel to the movement of the contact end when an electric fault is detected in the assembled configuration of the trip unit.

7. The trip unit according to claim 1, wherein the first case comprises a first hole, wherein the second case comprises a second hole, and wherein in the assembled configuration of the trip unit, the first and second holes are aligned and receive a fastening member for fastening the first case to the second case.

* * * * *